US005464216A

United States Patent [19]

Hoshi et al.

[11] Patent Number: 5,464,216

[45] Date of Patent: Nov. 7, 1995

[54] GOLF CLUB HEAD

[75] Inventors: Toshiharu Hoshi; Naoki Kamimura, both of Shizuoka, Japan

[73] Assignee: Yamaha Corporation, Japan

[21] Appl. No.: 237,456

[22] Filed: May 3, 1994

[30] Foreign Application Priority Data

May 6, 1993 [JP] Japan ..... 5-023315 U

[51] Int. Cl.[6] ..... A63B 53/04

[52] U.S. Cl. ..... 273/167 R; 273/167 H

[58] Field of Search ..... 273/167 R:167 A, 273/167 B, 167 C, 167 E, 167 F, 167 G, 167 H, 167 J, 167 K, 168, 169, 170, 171, 172, 173, 174, 175

[56] References Cited

U.S. PATENT DOCUMENTS

| | | | |
|---|---|---|---|
| 4,314,863 | 2/1982 | McCormick | 148/37 |
| 4,438,931 | 3/1984 | Motomiya | 273/80.2 |
| 4,749,197 | 6/1988 | Orlowski | 273/167 H |
| 4,854,580 | 8/1989 | Kobayashi | 273/167 A |
| 5,028,049 | 7/1991 | Mokeighen | 273/167 H |
| 5,089,067 | 2/1992 | Schumacher . | |
| 5,255,918 | 10/1993 | Anderson | 273/167 H |
| 5,322,206 | 6/1994 | Harada . | |

FOREIGN PATENT DOCUMENTS

| | | |
|---|---|---|
| 59-20182 | 2/1984 | Japan . |
| 64-68285 | 3/1989 | Japan . |
| 1320076 | 12/1989 | Japan . |

OTHER PUBLICATIONS

Askeland, Donald R., "The Science and Engineering of Materials", 1984 by Wadsworth, Inc.

*Primary Examiner*—Sebastiano Passaniti

*Attorney, Agent, or Firm*—Ostrolenk, Faber, Gerb & Soffen

[57] ABSTRACT

In construction of a composite golf club head made up of several shell components united together along their mating edges, a face shell component is made of titanium alloy and a rear shell component is made of pure titanium. The titanium alloy well withstands hard impact at shooting balls by a face whereas use of cheep pure titanium allows plastic shaping of the intricate rear shell component even at a low temperature to significantly lower the total production cost of the golf club head.

8 Claims, 3 Drawing Sheets

GOLF CLUB HEAD

BACKGROUND OF THE INVENTION

The present invention relates to a golf club head, and more particularly relates to improvement in productivity of a composite golf club head whilst maintaining necessary mechanical tenacity.

A composite golf club head is hollow in construction and made up of a plurality of shell components which are united together along their edges. Most typically, such a composite golf club head is made up of a face shell component and a rear shell component which are united together along their edges.

Although various metallic materials are usable for production, a large golf club head generally favors use of (α+β) type or β type titanium alloys because of their light weights and high degree of tenacities.

In production of a composite golf club head, a titanium alloy plate is first prepared by, for example, solution treatment. Then the plate is shaped by pressing into a crude shell of a required configuration. Finally, the crude shell is formed by trimming into a final shell component. Face and rear shell components so prepared are then united together along their edges to produce a hollow, composite golf club head.

(α+β) type or β type titanium alloys are in general very advantageous in their mechanical tenacity but disadvantageous in significant occurrence of spring back during production. In order to cover this disadvantage, it is generally employed in plastic deformation into intricate configurations to heat titanium alloy material up to a temperature in a range from 700° to 900° C . Introduction of such high temperature heating inevitably renders the production very complicated and, as a result, very expensive. As well known, titanium alloys, in particular the (α+β) type and the β type, are very expensive. Thus use of such titanium alloys undesirably boosts the total production cost of the resultant golf club head.

SUMMARY OF THE INVENTION

It is thus the object of the present invention to provide a composite golf club head which can be produced very easily but provided with necessary mechanical tenacity at its face.

In accordance with the basic aspect of the present invention, a golf club head is comprised of a face shell component made of titanium alloy and a rear shell component made of pure titanium, both shell component being united together along their edges.

DESCRIPTION OF THE PREFERRED EMBODIMENTS

Figure 1:
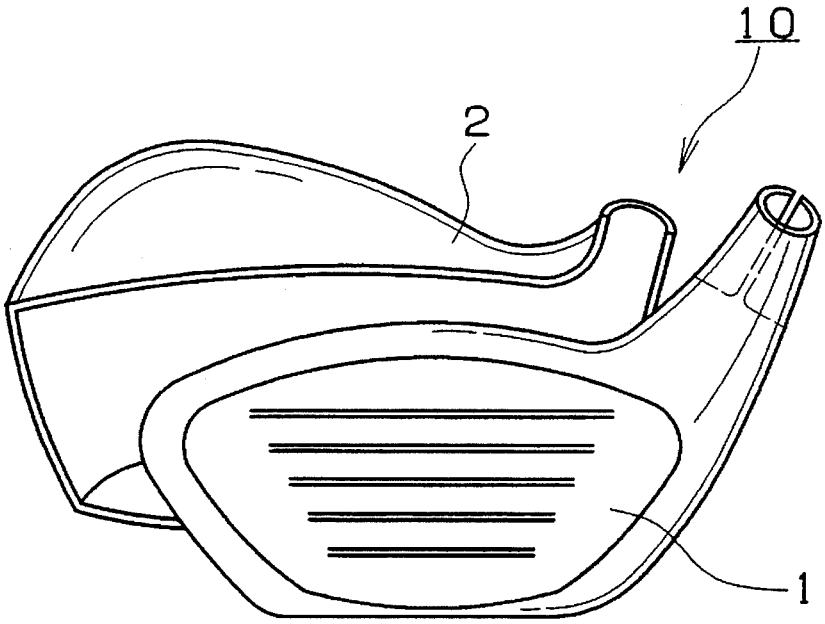
FIG. 1 is a perspective view of one example of the golf club head in accordance with the present invention in a disassembled state.

One example of the golf club head in accordance with the present invention is shown in FIG. 1 in a disassembled state. The golf club head 10 is made up of a face shell component 1 and a rear shell component 2 united to the face shell component 1 along their mating edges.

The rear shell component 2 is made of pure titanium which is classified as H 4600 (the second class) in JIS (Japan Industrial Standard). The face shell component 1 is made of (α+β) type or β type titanium alloys.

One example of such an (α+β) type alloy contains 4.0 to 7.0% by weight of Al, 3.0 to 7.0% by weight of V and Ti plus unavoidable impurities in balance. Optionally, it may further contain 1.0 to 3.0% by weight of Sn. Most typically, a Ti-6%Al-4%V alloy is used.

Such a β type alloy is given in the form of an alloy containing 1.0 to 5.0% by weight Al, 15.0 to 80.0% by weight of V, 0.5% by weight or less 0, 2.0% by weight or less of Fe and Ti plus unavoidable impurities in balance; or an alloy containing 1.0 to 5.0% by weight of Al, 15.0 to 25.0% by weight of V, 0.5 to 2.0% by weight of Sn, 0.5% by weight or less of 0, 2.0% by weight or less of Fe and Ti plus unavoidable impurities in balance; or an alloy containing 1.0 to 5.0% by weight of Al, 5.0 to 10.0% by weight of V, 3.0 to 8.0% by weight of Cr. 2.0 to 7.0% by weight of Mo, 2.0 to 7.0% by weight of Zr, 0.5% by weight or less of 0, 2.0% by weight or less of Fe and Ti plus unavoidable impurities in balance; an alloy containing 1.0 to 5.0 by weight of Al, 1.0 to 5.0% by weight of Sn, 1.0 to 5.0% by weight of Cr, 0.5% by weight or less of 0, 2.0% by weight or less of Fe and Ti plus unavoidable impurities in balance; or 1.0 to 5.0% by weight of Al, 3.0 to 7.0% by weight of Zr, 12.0 to 18.0% by weight of Mo and Ti plus unavoidable impurities in balance.

The composite type golf club head in accordance with the present invention is produced in, for example, the following manner.

Figure 2:
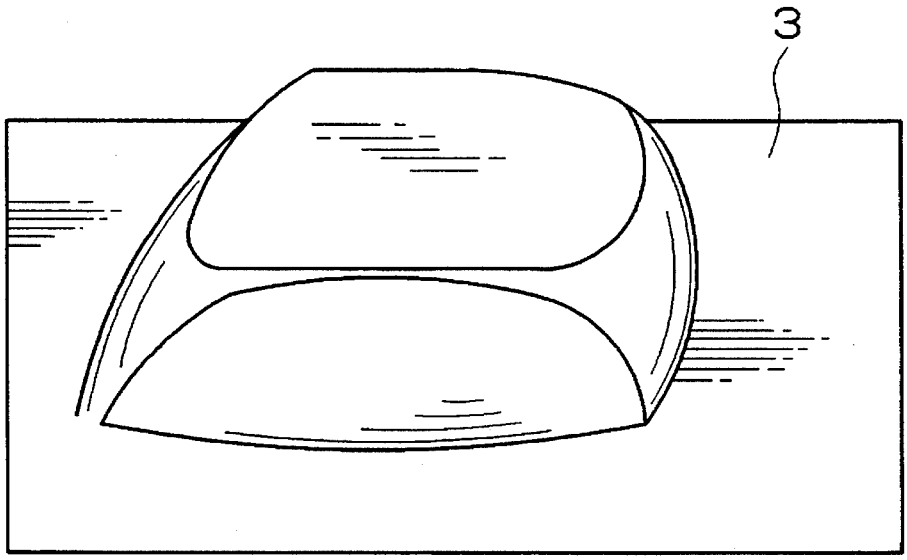
FIG. 2 is a perspective view of one production phase of a face shell component used for the golf club head shown in FIG. 1.
Figure 3:
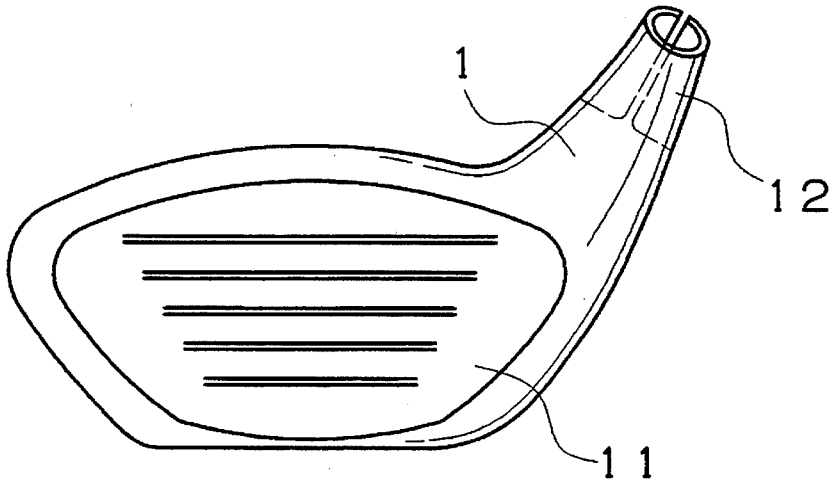
FIG. 3 is a perspective view of the face shell component.

First as shown in FIG. 2, a titanium alloy plate is shaped by pressing into a crude shell 3 of a required configuration. Next, the crude shell 3 is formed by trimming into a face shell component 1 such as shown in FIG. 3. In the case of this example, the face shell component 1 is provided with a face 11 and a hosel 12.

Figure 4:
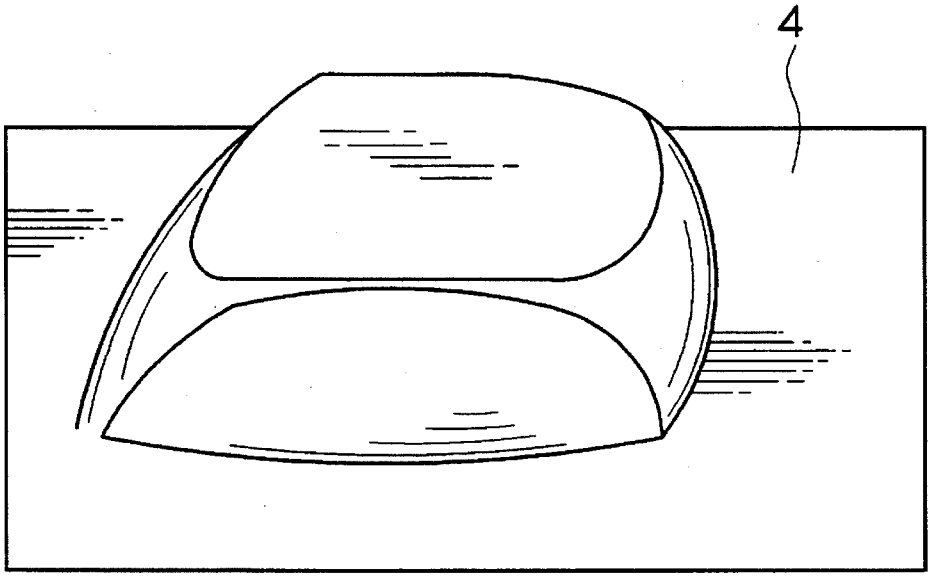
FIG. 4 is a perspective view of on production phase of a rear shell component used for the golf club head shown in FIG. 1.
Figure 5:
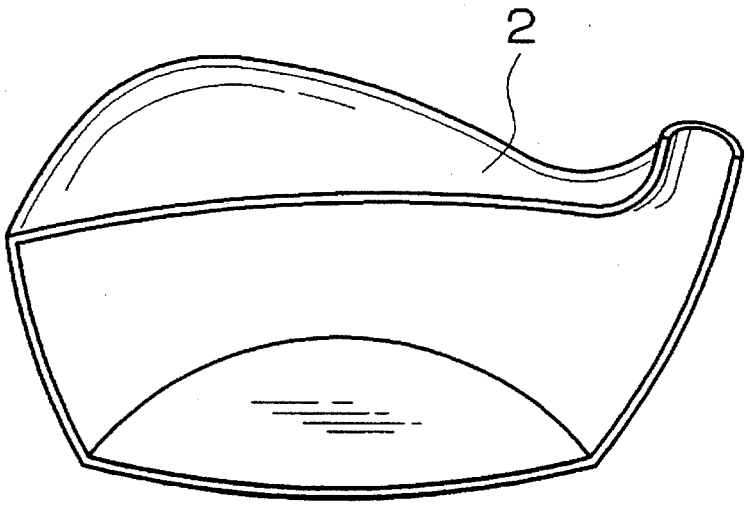
FIG. 5 is a perspective view of the rear shell component.

In a same manner, a pure titanium plate is shaped by pressing into a crude shell 4 such as shown in FIG. 4. Next, the crude shell 4 is formed by trimming into a rear shell component 2 such as shown in FIG. 5.

Since the original plate is made of pure titanium, pressing can be carried out very readily even at a low temperature in a range from the room temperature to 300° C .

Figure 6:
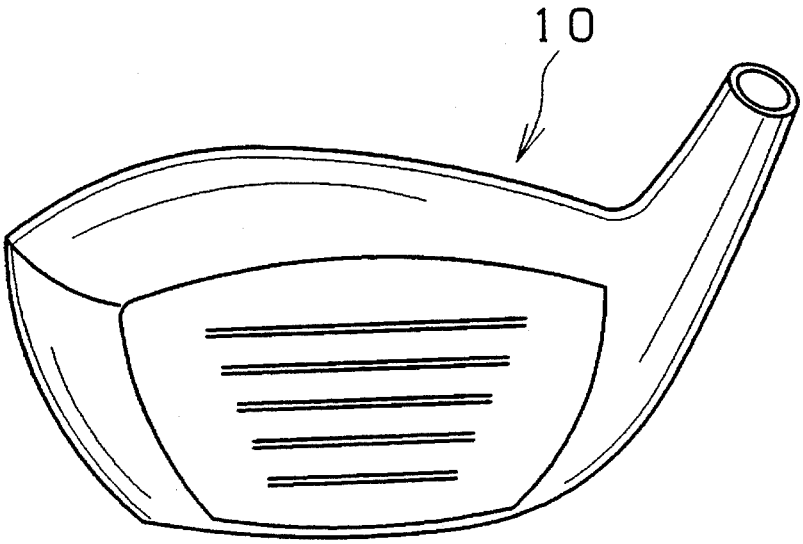
FIG. 6 is a perspective view of the golf club head in accordance with the present invention.

Finally, the face and rear components 1, 2 are united together by, for example, welding along their mating edges to obtain a golf club head 10 shown in FIG. 6. Depending on the type of the titanium alloy used for the face shell component, a proper heat treatment or treatments may be additionally employed.

In accordance with the present invention, use of the titanium alloy for the face shell component ensures high degree of mechanical tenacity at the face for shooting balls on one hand. On the other hand, use of the pure titanium for the rear shell component simplifies pressing of the material plate. In addition, lower cost of pure titanium than titanium alloys also greatly lowers the total production cost of the golf club head.

In the case of the foregoing example, the entire golf club head is made up of only two shell components. However, each component may be further divided into two or more subordinate components. For example, a rear shell component may be made up of a crown shell component and a sole shell component. The hosel may be formed in one body with either shell component or separately from the shell components. When separated, the hosel should preferably made of titanium alloy in order to assume sufficient mechanical tenacity.

We claim:

1. A golf club head comprising a face shell component made of titanium alloy, and a rear shell component made of pure titanium and united to said face shell component along their mating edges, the face shell having a higher tensile strength and a lower plastic deformability than the rear shell.

2. A golf club head as claimed in claim 1 in which at least one of said face and rear shell components is made up of two or more subordinate shell components.

3. A golf club head as claimed in claim 1 in which said titanium alloy for said face shell component is an ($\alpha$+$\beta$) type alloy.

4. A golf club head as claimed in claims 3 in which said ($\alpha$+$\beta$) type alloy contains 4.0 to 7.0% by weight of Al, 3.0 to 7.0% by weight of V and Ti plus unavoidable impurities in balance.

5. A golf club head as claimed in claim 4 in which said ($\alpha$+$\beta$) type alloy further contains 1.0 to 3.0% by weight of Sn.

6. A golf club head as claimed in claim 4 in which said ($\alpha$+$\beta$) type alloy is Ti-6%Al-4%V alloy.

7. A golf club head as claimed in claim 1 in which said titanium alloy for said face shell components is a $\beta$ type alloy.

8. A golf club head as claimed in claim 7 in which said $\beta$ type alloy is selected from $\alpha$ group consisting of an alloy containing 1.0 to 5.0% by weight of Al, 15.0 to 30.0% by weight of V, 0.5% by weight or less of 0, 2.0% by weight or less of Fe and Ti plus unavoidable impurities in balance; an alloy containing 1.0 to 5.0% by weight of Al, 15.0 to 25.0% by weight of V, 0.5 to 2.0% by weight of Sn, 0.5% by weight or less of 0, 2.0% by weight of Fe and Ti plus unavoidable impurities in balance; an alloy containing 1.0 to 5.0% by weight of Al, 5.0 to 10.0% by weight of V, 3.0 to 8.0% by weight of Cr, 2.0 to 7.0% by weight of Mo, 2.0 to 7.0% by weight of Zr, 0.5% by weight or less of 0, 2.0% by weight or less of Fe and unavoidable impurities in balance; an alloy containing 1.0 to 5.0% by weight of Al, 1.0 to 5.0% by weight of Sn, 1.0 to 5.0% by weight of Cr, 0.5% by weight or less of 0, 2.0% by weight or less of Fe and Ti plus unavoidable impurities in balance; and an alloy containing 1.0 to 5.0% by weight of Al, 3.0 to 7.0% by weight of Zr, 12.0 to 18.0% by weight of Mo and Ti plus unavoidable impurities in balance.

* * * * *